US010905304B2

(12) United States Patent
Beaudet et al.

(10) Patent No.: US 10,905,304 B2
(45) Date of Patent: Feb. 2, 2021

(54) USER INTERFACE FOR APPLIANCE CYCLE OPTIMIZATION

(71) Applicant: Whirlpool Corporation, Benton Harbor, MI (US)

(72) Inventors: Douglas B. Beaudet, Mattawan, MI (US); Vincent A. Ireland, Saint Joseph, MI (US); Traci L. Kachorek, Saint Joseph, MI (US); Barry E. Tuller, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 102 days.

(21) Appl. No.: 16/206,202

(22) Filed: Nov. 30, 2018

(65) Prior Publication Data

US 2019/0090717 A1 Mar. 28, 2019

Related U.S. Application Data

(63) Continuation of application No. 15/688,147, filed on Aug. 28, 2017, now Pat. No. 10,194,781, which is a (Continued)

(51) Int. Cl.
*A47L 15/00* (2006.01)

(52) U.S. Cl.
CPC ..... *A47L 15/0021* (2013.01); *A47L 15/0049* (2013.01); *A47L 2301/08* (2013.01); (Continued)

(58) Field of Classification Search
CPC ..... A47L 15/0021; A47L 15/0049; A47L 2301/08; A47L 2401/10; A47L 2401/12; (Continued)

(56) References Cited

U.S. PATENT DOCUMENTS 4,735,219 A 4/1988 Seeland
5,124,942 A 6/1992 Nielsen et al.
(Continued)

FOREIGN PATENT DOCUMENTS

CN 1749466 3/2006
EP 0748892 12/1996
(Continued)

OTHER PUBLICATIONS

Delport, V., "Low-Cost Embedded Digital Control of Traditionally Discrete Analog Appliance Designs.", Application Manager, Security Microcontroller and Technology Development Division, Microchip Technology Inc., Nov. 2006, http://www.ecnasiamag.com/article-11264-lowcostembedded-digitalcontroloftraditionallydiscreteanalogappliancedesigns-Asia.html.
(Continued)

*Primary Examiner* — Douglas Lee

(74) *Attorney, Agent, or Firm* — Diederiks & Whitelaw, PLC.

(57) ABSTRACT

A method of operating an appliance including determining user satisfaction with an operation cycle, adjusting at least one operational parameter of the cycle based on the user satisfaction, and incorporating the adjusted operational parameter into a subsequent cycle is disclosed along with the apparatus including a processor configured to perform the method.

20 Claims, 4 Drawing Sheets

Related U.S. Application Data continuation of application No. 12/713,657, filed on Feb. 26, 2010, now Pat. No. 9,743,820.

(52) U.S. Cl.
CPC ..... *A47L 2401/10* (2013.01); *A47L 2401/12* (2013.01); *A47L 2501/26* (2013.01); *A47L 2501/30* (2013.01)

(58) Field of Classification Search
CPC .. A47L 2501/26; A47L 2501/30; D06F 75/26; D06F 33/00; D06F 33/02; D06F 34/18; D06F 34/22; D06F 34/28; D06F 39/003; D06F 39/004; D06F 39/005
See application file for complete search history.

(56) References Cited

U.S. PATENT DOCUMENTS

| | | | | |
|---|---|---|---|---|
| 5,905,648 | A | 5/1999 | Badami | |
| 5,920,477 | A | 7/1999 | Hoffberg et al. | |
| 6,137,095 | A | 10/2000 | Kashimoto et al. | |
| 6,464,798 | B1 | 10/2002 | Rosenbauer et al. | |
| 6,502,265 | B2 | 1/2003 | Blair et al. | |
| 6,519,871 | B2 | 2/2003 | Gardner et al. | |
| 6,563,430 | B1 | 5/2003 | Kemink et al. | |
| 6,845,290 | B1 | 1/2005 | Wunderlin et al. | |
| 6,850,252 | B1 | 2/2005 | Hoffberg | |
| 6,873,876 | B1 | 3/2005 | Aisa | |
| 7,069,090 | B2 | 6/2006 | Huffington et al. | |
| 7,069,109 | B2 | 6/2006 | Huffington | |
| 7,110,836 | B2 | 9/2006 | Sturm et al. | |
| 7,127,270 | B2 | 10/2006 | Sinclair | |
| 7,136,710 | B1 | 11/2006 | Hoffberg et al. | |
| 7,177,712 | B2 * | 2/2007 | Blair | G05B 19/108 700/83 |
| 7,235,762 | B2 | 6/2007 | Gagas et al. | |
| 7,260,604 | B2 | 8/2007 | Kuki | |
| 7,389,208 | B1 | 6/2008 | Solinsky | |
| 2001/0049846 | A1 * | 12/2001 | Guzzi | D06F 33/00 8/158 |
| 2003/0037382 | A1 * | 2/2003 | Broker | D06F 37/203 8/158 |
| 2005/0000544 | A1 | 1/2005 | Cho et al. | |
| 2006/0237044 | A1 | 10/2006 | Ferguson et al. | |
| 2006/0237052 | A1 | 10/2006 | Picardat et al. | |
| 2006/0287850 | A1 | 12/2006 | Morikawa | |
| 2007/0124466 | A1 | 5/2007 | Brown | |
| 2007/0156892 | A1 | 7/2007 | Brown | |
| 2007/0240738 | A1 | 10/2007 | Heissler et al. | |
| 2007/0272272 | A1 | 11/2007 | Choi et al. | |
| 2008/0046278 | A1 | 2/2008 | Sanville et al. | |
| 2008/0115807 | A1 | 5/2008 | Gaus | |
| 2008/0314423 | A1 | 12/2008 | Berends et al. | |

FOREIGN PATENT DOCUMENTS

| | | | |
|---|---|---|---|
| JP | 2008/009573 | 1/2008 | |
| WO | 2008/017910 | 2/2008 | |
| WO | WO-2008017910 A2 * | 2/2008 | A47L 15/4293 |
| WO | 2009/043175 | 4/2009 | |

OTHER PUBLICATIONS

Angulo, B. et al., "Distributed Intelligence for Smart Home Appliances.", Knowledge Engineering Research Group Eric, Engineering & Research in Computational Intelligence, http://www.ouroboros.org/papers/distributed.pdf.

* cited by examiner

USER INTERFACE FOR APPLIANCE CYCLE OPTIMIZATION

CROSS REFERENCE TO RELATED APPLICATION

This application is a continuation of U.S. application Ser. No. 15/688,147, filed on Aug. 28, 2018 and titled "User Interface for Dishwashing Cycle Optimization", which is a continuation of U.S. application Ser. No. 12/713,657, now U.S. Pat. No. 9,743,820, filed on Feb. 26, 2010 and titled "User Interface for Dishwashing Cycle Optimization". The entire content of these applications is incorporated herein by reference.

TECHNICAL FIELD

The present disclosure relates generally to an appliance and more particularly to a mechanism and method of soliciting user input regarding the performance of the appliance during an operation cycle.

BACKGROUND

A dishwashing machine is a domestic appliance into which dishes and other cooking and eating wares (e.g., plates, bowls, glasses, flatware, pots, pans, bowls, and etcetera) are placed to be washed. A dishwashing machine includes a number of dish racks which support such wares.

SUMMARY

According to one aspect, a method of operating an appliance is disclosed. For example, the method includes determining user satisfaction with a dishwashing cycle, adjusting at least one operational parameter of the dishwashing cycle associated with the user satisfaction, and incorporating the adjusted operational parameter into a subsequent dishwashing cycle. In some embodiments, the method may include identifying at least one operating condition of the dishwashing cycle associated with the user satisfaction, and the adjusted operational parameter may be incorporated into a subsequent dishwashing cycle when the identified operating condition is present in the subsequent dishwashing cycle. In some embodiments, determining the user satisfaction with the dishwashing cycle may include soliciting user input regarding a number of characteristics of dishwasher performance, receiving a user-input signal indicative of the user satisfaction with the dishwashing cycle, and identifying an unsatisfactory characteristic of dishwasher performance based on the user-input signal.

In some embodiments, the number of characteristics of dishwasher performance may include washing quality, drying quality, dishwashing cycle duration, and noise generated during the dishwashing cycle. Additionally, in some embodiments, adjusting at least one operational parameter of the dishwashing cycle may include selecting an operational parameter associated with the unsatisfactory characteristic of dishwasher performance, and adjusting the selected operational parameter.

In some embodiments, adjusting the selected operational parameter may include determining whether additional adjustments are available for the selected operational parameter. In some embodiments, identifying the unsatisfactory characteristic of dishwasher performance may include identifying a stage of the dishwashing cycle exhibiting unsatisfactory performance.

In some embodiments, identifying the unsatisfactory characteristic of dishwasher performance may include identifying a location within the dishwasher exhibiting unsatisfactory performance. In some embodiments, identifying the unsatisfactory characteristic of dishwasher performance may include identifying one of a plurality of ware types not satisfactorily cleaned.

In some embodiments, adjusting at least one operational parameter of the dishwashing cycle may include selecting at least one operational parameter associated with the identified stage, the identified location, and the identified ware type. Once selected, the selected operational parameter is adjusted to improve cleaning quality.

According to another aspect, a method of operating a dishwashing machine includes operating a dishwashing machine in accordance with a dishwashing cycle, communicating with a plurality of sensors to determine the operating conditions present in the dishwashing cycle, determining user satisfaction with dishwasher performance at the conclusion of the dishwashing cycle, adjusting an operational parameter of the dishwashing cycle based on the user satisfaction, identifying at least one operating condition of the dishwashing cycle associated with the user satisfaction, and incorporating the adjusted operational parameter into a subsequent dishwashing cycle when the identified operating condition is present in the subsequent dishwashing cycle. In some embodiments, communicating with the plurality of sensors may include communicating with a soil sensor to determine the soil level of fluid in the dishwashing machine, and communicating with a temperature sensor to determine the temperature of fluid in the dishwashing machine.

In some embodiments, the method may further include determining a number of user preferences for the dishwashing cycle, and adjusting the operational parameter may include adjusting at least one operational parameter associated with at least one of the number of user preferences when the user is determined to be satisfied with the dishwashing cycle. In some embodiments, incorporating the adjusted operational parameter into the subsequent dishwashing cycle includes communicating with the plurality of sensors to determine operating conditions present in the subsequent dishwashing cycle, determining that at least one operating condition present in the subsequent dishwashing cycle is equal to the identified operating condition, and modifying the subsequent dishwashing cycle to include the adjusted operational parameter.

In some embodiments, the method may further include determining whether the selected operational parameter can be adjusted. In some embodiments, determining whether the selected operational parameter can be adjusted may include identifying a current value of the selected operational parameter, comparing the current value of the selected operational parameters to a predetermined threshold of the selected operational parameter, and generating an error message when the current value is equal to the predetermined threshold.

According to another aspect, a dishwashing machine is disclosed. The dishwashing machine includes a washing chamber, a number of dish racks positioned in the washing chamber, a pump operable to circulate fluid onto the number of dish racks, a user interface operable to receive user input and generate an electrical output signal indicative thereof, and an electronic controller electrically coupled to the pump and the user interface. The controller includes a processor, and a memory device electrically coupled to the processor. The memory device has stored therein a plurality of instructions which, when executed by the processor, cause the processor to operate the pump in accordance with a selected dishwashing cycle, determine user satisfaction with the selected dishwashing cycle based on the electrical output signal generated by the user interface, adjust at least one operational parameter of the selected dishwashing cycle based on the user satisfaction, and incorporate the adjusted operational parameter into a subsequent dishwashing cycle.

In some embodiments, the dishwashing machine may also include a sensor electrically coupled to the electronic controller. The sensor may be operable to measure a characteristic of the dishwashing cycle and generate an electrical output signal indicative thereof. The plurality of instructions which, when executed by the processor, may cause the processor to communicate with the sensor to record a plurality of measurements and determine the operating conditions of the selected dishwashing cycle, and identify at least one operating condition of the selected dishwashing cycle associated with the user satisfaction.

In some embodiments, the plurality of instructions which, when executed by the processor, may cause the processor to solicit user input regarding a number of characteristics of dishwasher performance, and identify an unsatisfactory characteristic of dishwasher performance from the number of characteristics.

In some embodiments, the user interface may be a touchscreen operable to display the number of characteristics of dishwasher performance.

BRIEF DESCRIPTION OF THE DRAWINGS

The detailed description particularly refers to the following figures, in which.

DETAILED DESCRIPTION OF THE DRAWINGS

Figure 1:
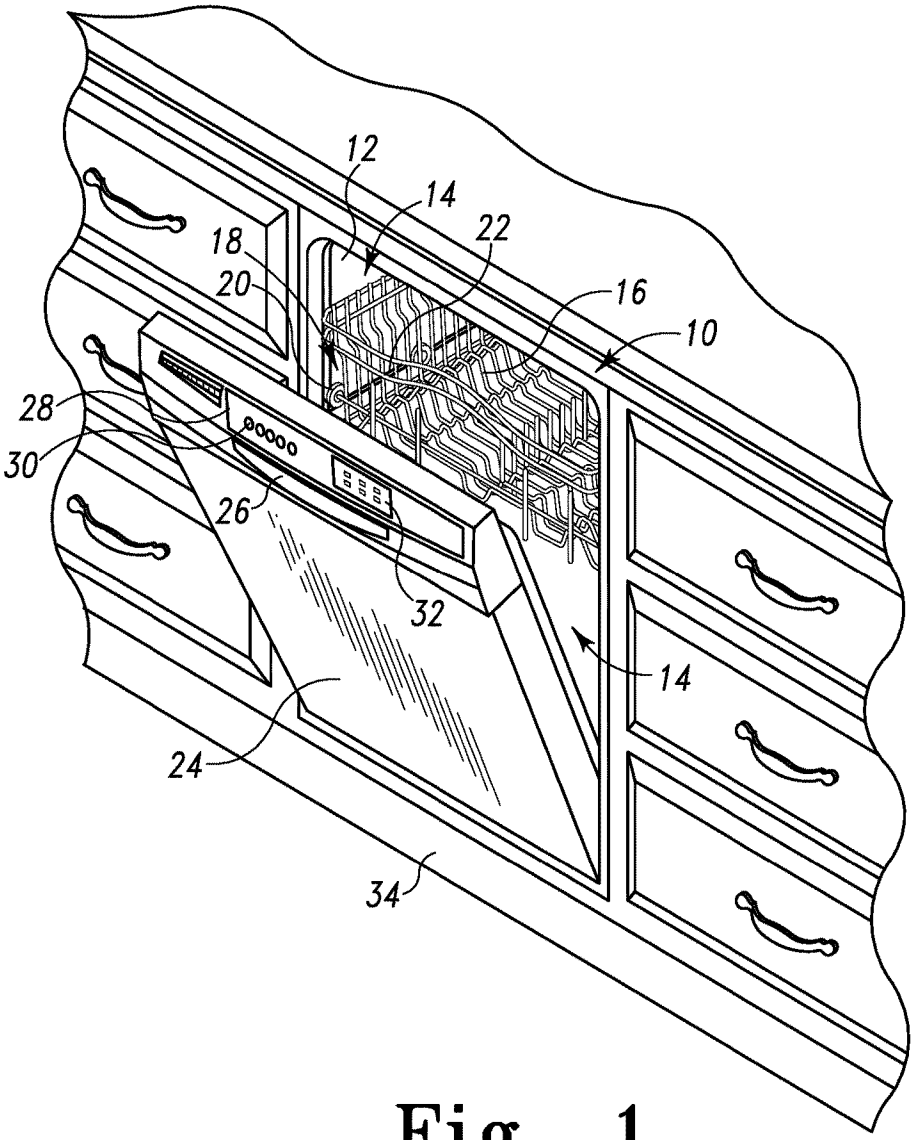
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

The present disclosure relates to a method and mechanism for soliciting user feedback regarding the performance of the dishwashing machine during a dishwashing cycle. By use of the term "dishwashing cycle," it is meant the operation of a dishwashing machine upon a set of soiled wares that produces a set of cleaned wares, starting with user activation, then proceeding continuously without the need for user intervention, and including at least one washing stage and at least one rinsing stage. A washing stage involves the application of wash chemistry, typically water and detergent, to remove soils from the wares. A rinsing stage that involves the application of rinse chemistry, typically water and rinse aid, to remove the wash chemistry and prepare the wares for drying. A dishwashing cycle may optionally include other stages, such as a drying stage in which heat may be applied after a washing or a rinsing stage. A dishwashing cycle may be interrupted by a user, such as by opening a door of the dishwasher, thereby causing the dishwashing cycle to pause until the door is closed. However, without such user intervention, the dishwashing cycle will proceed continuously.

At the completion of a dishwashing cycle, a user will remove the set of cleaned wares, either immediately or after a period of time. The period between the dishwashing cycles of the dishwasher thus begins when the user removes a set of cleaned wares from the dishwasher and ends when the user activates a subsequent dishwashing cycle.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1; although a lower dish rack is also included in the dishwasher 10. A number of roller assemblies 18 are positioned between the dish racks 16 and the tub 12. The roller assemblies 18 allow the dish racks 16 to extend from and retract into the tub 12, thereby facilitating the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a dishwashing cycle. A handle 26 is included on the door 24. The user may use the handle 26 to unlatch and open the door 24 such that the user may access the tub 12.

A control panel 28 is located at the top of the door 24. The control panel 28 includes a number of controls 30, such as buttons and knobs, and a touchscreen panel 32 that are used to control the operation of the dishwasher 10. In other embodiments, the touchscreen panel 32 may be the sole control located on the control panel 140, thus permitting a user to control all user accessible operations of the dishwasher 100 via the touchscreen panel 32. Additionally, in other embodiments, the control panel 28 may include a display panel such as a liquid crystal display (LCD) panel or some other type of display panel along with one or more buttons associated with the display panel that may be actuated to control operation of the dishwasher 10. In other embodiments, the control panel 28 may include only buttons and knobs that may be actuated to control operation of the dishwasher 10. In still other embodiments, the dishwasher 10 may have a remote user interface such that the user may control the operation of the dishwasher 10 when not at home or when elsewhere in the house. The remote user interface in such embodiments may be, for example, a software program loaded on a computer, cell phone, or personal digital assistant.

A machine compartment 34 is located below the tub 12. The machine compartment 34 is sealed from the tub 12. In other words, unlike the tub 12, which is filled with fluid and exposed to spray during the dishwashing cycle, the machine compartment 34 does not fill with fluid and is not exposed to spray during the operation of the dishwasher 10. The machine compartment 34 houses components such as the dishwasher's water pump(s) and valve(s), along with the associated wiring and plumbing. It should be noted that, although FIG. 1 depicts a dishwasher 10 installed in a kitchen cabinet, portable dishwashers, which may be removably connected to a faucet, are also contemplated.

Figure 2:
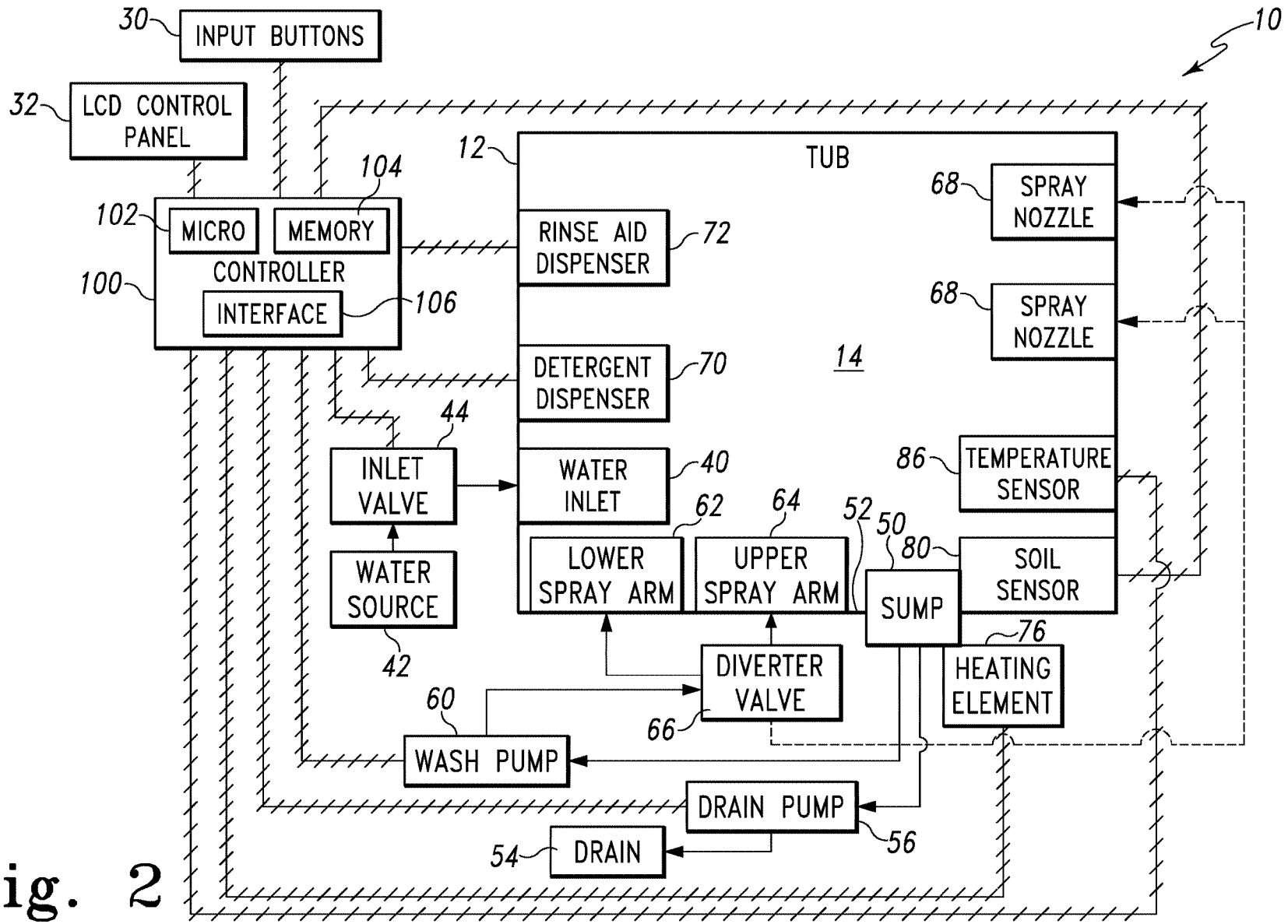
FIG. 2 is a simplified block diagram of one illustrative embodiment of a control system for the dishwashing machine of FIG. 1.

Referring now to FIG. 2, the dishwasher 10 is shown in a simplified block diagram. A sidewall of the tub 12 includes a water inlet 40. The water inlet 40 directs water received from an external water source 42 (e.g., house water supply, kitchen faucet, etcetera) into the washing chamber 14. A water inlet valve 44 positioned between the external water source 42 and the water inlet 40 may be selectively opened or closed to control the flow of water through the water inlet 40. In some embodiments, the water inlet valve 44 may be an electromechanical valve, such as a solenoid-controlled valve, which opens and closes in response to a control signal.

The dishwasher 10 further includes a sump 50 which is formed (e.g., stamped, molded, or assembled) into a bottom wall 52 of the tub 12. In particular, the sump 50 defines a reservoir that extends downwardly in a direction away from the washing chamber 14. The bottom wall 52 of the tub 12 is shaped such that wash chemistry or rinse chemistry is directed into the sump 50. The sump 50 is connected to an external drain 54 (e.g., house sewer line, kitchen sink, etcetera). A drain pump 56 is positioned between the sump 50 and the external drain 54. A control signal may selectively energize the drain pump 56 to drain fluids from the sump 50 or de-energize (turn off) the drain pump 56 to retain fluids in the sump 50. In other embodiments, an electromechanical valve, such as a solenoid-controlled valve, that opens and closes in response to a control signal may be used in place of drain pump 56.

A wash pump 60 located in the machine compartment 34 is operable to circulate fluids in the sump 50 onto the dish racks 16 (not shown in FIG. 2). The wash pump 60 is fluidly coupled to a lower rotating spray arm 62 and an upper rotating spray arm 64 through a diverter valve 66. The spray arms 62, 64 are configured to spray water and/or wash chemistry onto the dish racks 16 (and hence any wares positioned thereon). It should also be appreciated that the dishwashing machine 10 may include other spray arms positioned at various locations in the tub 12.

The diverter valve 66 may also connect the wash pump 60 to one or more spray nozzles 68 designed to target particular zones of the washing chamber 14 or to spray one or more dish racks 16 in a particular manner (e.g., high-pressure spray, low-pressure mist, etcetera). In operation, the wash pump 60 is selectively energized to supply fluid from the sump 50 through diverter valve 66 to one of the spray arms 62, 64 or the spray nozzles 68. It should be appreciated that in other embodiments the diverter valve 66 may be omitted such that the wash pump 60 is connected directly to the spray arms 62, 64 and/or the spray nozzles 68.

The diverter valve 66 is positioned between the wash pump 60 and the spray arms 62, 64 and the spray nozzles 68. The diverter valve 66 is configured to divert the supply of fluid from the wash pump 60 to the lower spray arm 62, the upper spray arm 64, and the spray nozzles 68. When placed in one position, the diverter valve 66 causes fluid to be supplied to the lower spray arm 62. When placed in another position, fluid is supplied to the upper spray arm 64 or the spray nozzles 68. In that way, the diverter valve 66 allows fluid to be alternately supplied to each of the spray arms 62, 64 and the spray nozzles 68. Fluid can therefore be supplied to any one, all, or some combination of the spray arms 62, 64 and the spray nozzles 68.

The dishwasher 10 includes a detergent dispenser 70 that operates to introduce a detergent, typically in either powder, gel, or tablet form, into the washing chamber 14. The introduced detergent mixes with water in the washing chamber 14 to form a wash chemistry which is applied to aid in the removal of soils from wares during a washing stage of a wash cycle. The detergent dispenser 70 may be located on the surface of the door 24 that faces the washing chamber 14, such that a user may easily refill the detergent dispenser 70 with detergent when the door 24 is opened between wash cycles. In some embodiments, the detergent dispenser 70 may include an electromechanical valve, such as a solenoid-controlled valve, which opens and/or closes in response to a control signal.

The dishwasher 10 also includes a rinse aid dispenser 72 that operates to introduce a rinse aid, typically in either liquid or gel form, into the washing chamber 14. A "rinse aid" may include a surface acting agent (also known as a surfactant), one or more sanitizing chemicals (such as bleach, for example), or both, and may contain other chemistries. A rinse aid may be a single mixture or may be stored as two or more separate components until introduction into the washing chamber 14. In some embodiments, the rinse aid dispenser 72 may include an electromechanical valve, such as a solenoid-controlled valve, which opens and/or closes in response to a control signal, thereby introducing a metered amount of rinse aid into the washing chamber 14

Upon introduction, the rinse aid mixes with fluid in the washing chamber 14 to form a rinse chemistry that assists in rinsing the wash chemistry from the wares during a rinsing stage. Applying the rinse chemistry to the wares also improves the drying performance of dishwasher 10 and assists in sanitizing the wares during the drying stage of the dishwashing cycle.

An electric heating element 76 is positioned adjacent to the sump 50 and is configured to heat fluid in the sump 50. In other embodiments, the heating element 76 may be located in the sump 50 or at another position in fluid communication with the washing pump 60. During a drying stage of the dishwashing cycle when fluid is not being circulated in the washing chamber 14, the electric heating element 76 may be used to increase the temperature in the washing chamber 14 to dry the wares positioned therein. It will be appreciated that in other embodiments the electric heating element 76 may be integrated into the sump 50 or may be embodied as one or more electric heating elements.

A soil sensor 80 is optionally positioned in or adjacent to the washing chamber 14 to monitor the soil in the fluid in the washing chamber 14. As embodied in FIG. 2, the soil sensor 80 is an optical water indicator sensor that provides an indication of fluid clarity at any point during the dishwashing cycle and generates an electrical output signal indicative of the turbidity level of the fluid. The output signal is proportionate to the amount of soil, detergent, or rinse aid present in fluid in the washing chamber 14. As the amount of soil, detergent, or rinse aid increases, the output signal increases by a proportionate amount.

A temperature sensor 86 may be optionally positioned in or adjacent to the washing chamber 14 to measure the temperature of fluid in the washing chamber 14. In other embodiments, the temperature sensor 86 and the soil sensor 80 may be included in a single sensor housing. It will be appreciated that the soil sensor 80 and/or the temperature sensor 86 may be integrated into the sump 50. The temperature sensor 86 is configured to take a temperature measurement of the fluid in the washing chamber 14 and generate an electrical output signal indicative of that measurement.

The dishwasher 10 also includes an electronic control unit (ECU) or "electronic controller" 100. The electronic controller 100 may be positioned in the door 24 or the machine compartment 34 of the dishwasher 10. The electronic controller 100 is, in essence, the master computer responsible for interpreting electrical signals sent by sensors associated with the dishwasher 10 and for activating or energizing electronically-controlled components associated with the dishwasher 10. For example, the electronic controller 100 is configured to control operation of the various components of the dishwasher 10, including the wash pump 60, rinse aid dispenser 72, and inlet valve 44. The electronic controller 100 also monitors various signals from the control panel 28, including the touchscreen 32, the soil sensor 80, and any other sensor. The electronic controller 100 also determines when various operations of the dishwasher 10 should be performed. As will be described in more detail below with reference to FIGS. 3 and 4, the electronic controller 100 is operable to control the components of the dishwasher 10 such that the dishwasher 10 solicits user input regarding dishwasher performance and adjusts operational parameters of the dishwasher 10 in response thereto.

To do so, the electronic controller 100 includes a number of electronic components commonly associated with electronic units utilized in the control of electromechanical systems. For example, the electronic controller 100 may include, amongst other components customarily included in such devices, a processor such as a microprocessor 102 and a memory device 104 such as a programmable read-only memory device ("PROM") including erasable PROM's (EPROM's or EEPROM's). The memory device 104 is provided to store, amongst other things, instructions in the form of, for example, a software routine (or routines) which, when executed by the microprocessor 102, allows the electronic controller 100 to control operation of the dishwasher 10.

The electronic controller 100 also includes an analog interface circuit 106. The analog interface circuit 106 converts the output signals from various sensors (e.g., the soil sensor 80) into signals which are suitable for presentation to an input of the microprocessor 102. In particular, the analog interface circuit 106, by use of an analog-to-digital (A/D) converter (not shown) or the like, converts the analog signals generated by the sensors into digital signals for use by the microprocessor 102. It should be appreciated that the A/D converter may be embodied as a discrete device or number of devices, or may be integrated into the microprocessor 102. It should also be appreciated that if any one or more of the sensors associated with the dishwasher 10 generate a digital output signal, the analog interface circuit 106 may be bypassed.

Similarly, the analog interface circuit 106 converts signals from the microprocessor 102 into output signals which are suitable for presentation to the electrically-controlled components associated with the dishwasher 10 (e.g., the rinse aid dispenser 72). In particular, the analog interface circuit 106, by use of a digital-to-analog (D/A) converter (not shown) or the like, converts the digital signals generated by the microprocessor 102 into analog signals for use by the electronically-controlled components associated with the dishwasher 10. It should be appreciated that, similar to the A/D converter described above, the D/A converter may be embodied as a discrete device or number of devices, or may be integrated into the microprocessor 102. It should also be appreciated that if any one or more of the electronically-controlled components associated with the dishwasher 10 operate on a digital input signal, the analog interface circuit 106 may be bypassed.

Thus, the electronic controller 100 may control the operation of the dishwasher 10 in accordance with the selected dishwashing cycle. In particular, the electronic controller 100 executes a routine including, amongst other things, a control scheme in which the electronic controller 100 monitors outputs of the sensors associated with the dishwasher 10 to control the inputs to the electronically-controlled components associated therewith. To do so, the electronic controller 100 communicates with the sensors associated with the dishwasher 10 to determine, amongst numerous other things, the temperature of fluid in the washing chamber 14 and the turbidity of fluid in the washing chamber 14. Armed with this data, the electronic controller 100 performs numerous calculations, either continuously or intermittently, including looking up values in preprogrammed tables, in order to execute algorithms to perform such functions as controlling the drain pump 56 to retain fluid in the sump 50, determining when to operate the detergent dispenser 70 or the rinse aid dispenser 72 to release chemistry into the tub 12, controlling the wash pump 60 to apply fluid to the wares positioned in the dishwasher 10, and so on.

As will be appreciated by those of the skill in the art, the dishwasher 10 may include elements other than those shown and described above, such as, by way of example, an additional electric heating element to assist in drying the wares or a filter to remove particulates from the re-circulated wash chemistry or rinse chemistry. The dishwasher 10 may also include a variety of other sensors that monitor conditions within the washing chamber 14, the sump 50, and/or other components of the dishwasher 10. It should also be appreciated that the location of many components (i.e., in the washing chamber 14, in the machine compartment 34, in or on the door 24) may also be altered.

Figure 3:
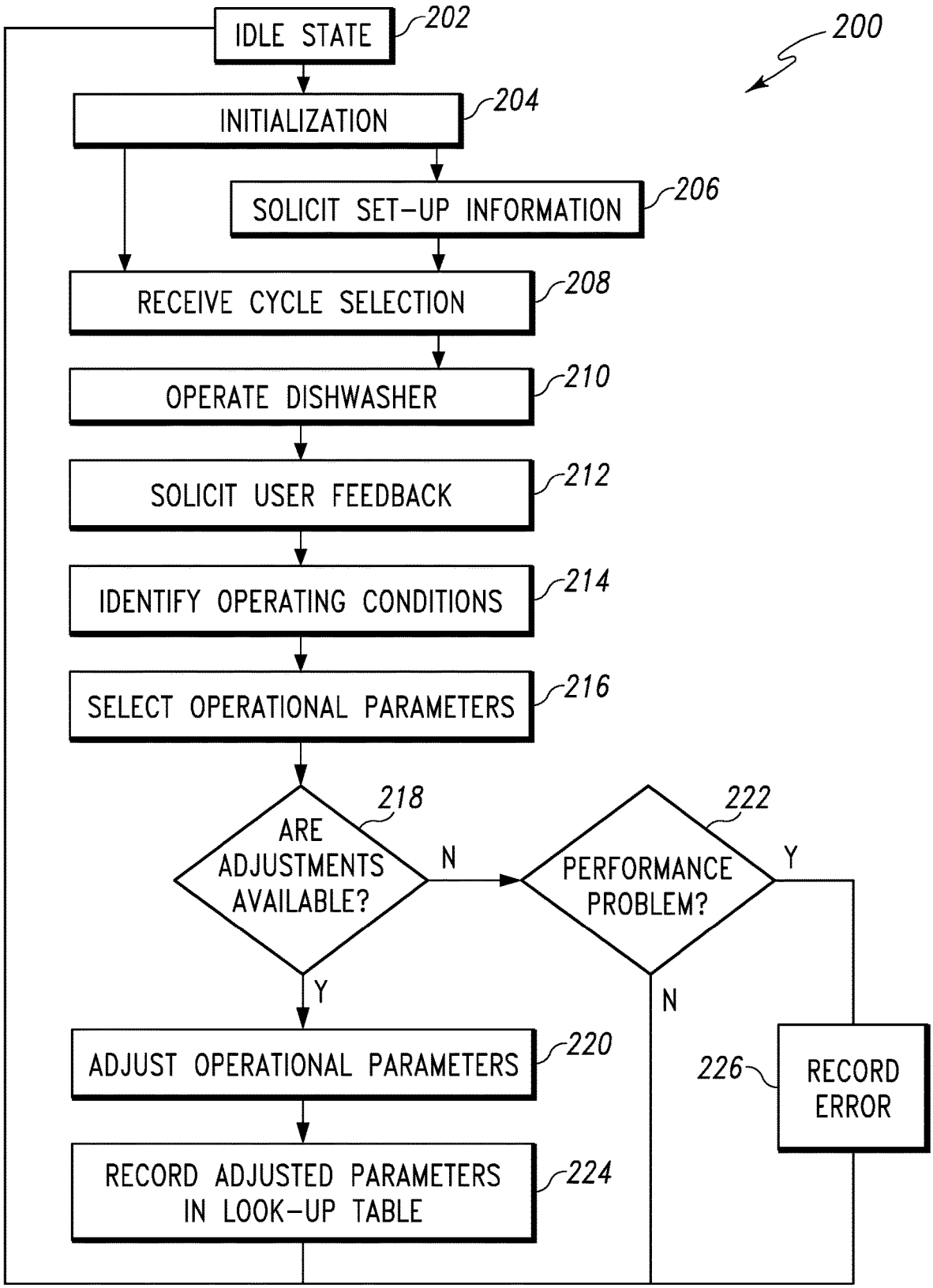
FIG. 3 is a simplified flow chart of a control routine for optimizing a dishwashing cycle.

Referring now to FIG. 3, an illustrative embodiment of a control routine 200 for operating the dishwasher 10 in accordance with a selected dishwashing cycle and soliciting user input at the conclusion of that dishwashing cycle is shown. When the user first accesses the control panel 28, the dishwasher 10 is in an idle state (step 202). The controller 100 then executes an initialization step 204 during which the touchscreen panel 32 activates and displays one or more initialization instructions. In particular, the touchscreen 32 displays initialization instructions prompting the user to (1) touch a particular area of the touchscreen 32 or push a particular control 30 to access a set-up menu or (2) touch another area of the touchscreen 32 or push another control 30 to access a menu of dishwashing cycles. If the user chooses to access the set-up menu, the routine 200 advances to step 206. If the user chooses to access the menu of dishwashing cycles, the routine 200 advances to step 208.

In step 206, the user is prompted to enter information related to the operation of dishwasher 10. For example, the user may be prompted to enter the detergent and/or rinse aid type to be used in the dishwashing cycle using the touchscreen 32. Additionally, the user may provide an indication of typical water hardness in the user's home and/or indicate the types of wares typically placed in the dishwasher 10. The user may also be prompted to enter various preferences related to the performance of the dishwasher 10. For example, the user may indicate a preference for the dishwasher 10 to generate less noise during dishwashing cycles or that dishwashing cycles should be ecologically-friendly. The user inputs are stored in the memory device 104 at the end of step 206 such that the controller 100 may access them later. When step 206 is complete, the routine 200 advances to step 208.

In step 208, the touchscreen 32 displays a list of dishwashing cycles, such as, for example, a normal cycle for typical loads, a heavy duty cycle for pots and pans, a light duty cycle for glasswares or plastics, and so on. The user is prompted to touch a particular area of the touchscreen 32 or push a particular control 30 to select a dishwashing cycle. Once the user selects a dishwashing cycle, the routine 200 advances to step 210.

In step 210, the dishwasher 10 performs the dishwashing cycle selected in step 208. As described above, a dishwashing cycle includes at least a washing stage (i.e., the main washing stage), in which a detergent chemistry containing water and a detergent is applied to the dish racks 16, and a rinsing stage, in which a rinse chemistry containing water and a rinse aid is applied to the dish racks 16. The selected dishwashing cycle may also include a pre-soak stage, a pre-washing stage, a secondary washing stage that occurs after the main washing stage, or a pre-final rinsing stage or a first rinsing stage that follows the main washing stage. During the dishwashing cycle, the inlet valve 44 is selectively operated to supply fluid to the tub 12 at the beginning of a particular stage and the drain pump 56 is selectively operated to drain fluid at the end of a particular stage. The electric heating element 76 is also selectively operated to increase the temperature in the washing chamber 14 to heat the fluid in the sump 50 when fluid is present in the sump 50 or dry the wares positioned on the dish racks 16.

Throughout the performance of the selected dishwashing cycle, the controller 100 communicates with the soil sensor 80, the temperature sensor 86, and any other sensor. The measurements taken by those sensors are recorded in the memory device 104. The controller 100 uses the sensor measurements to determine the current operating conditions within the dishwasher 10. The controller 100 then compares the current operating conditions to a number of historic operating conditions stored in a look-up table in the memory device 104. The look-up table includes a number of values for adjusted or modified operational parameters stored as a function of the historic operating conditions. When at least one of the current operating conditions is present in the look-up table, the controller 100 selects the value of the one or more adjusted operational parameters associated with the current operating condition. The controller 100 then incorporates the adjusted operational parameter into the dishwashing cycle to attempt to improve the performance of dishwasher 10. At the conclusion of the dishwashing cycle, the routine proceeds to step 212.

In step 212, the controller 100 solicits user feedback to determine user satisfaction with the concluded dishwashing cycle. The touchscreen 32 displays a request for user feedback regarding the performance of the dishwasher 10. The touchscreen 32 prompts the user to indicate whether she was satisfied with overall dishwasher performance. The touchscreen 32 may also solicit user input regarding a plurality of characteristics of dishwasher performance. Such characteristics include, for example, the washing quality of the dishwasher 10, the cycle duration, and the noise generated by the dishwasher 10 during the dishwashing cycle. After the controller 100 receives the user input, or after the expiration of a predetermined period of time, the routine 200 advances to step 214. It should be appreciated that in other embodiments the controller 100 may interpret no input from the user as an indication that the user was satisfied with overall dishwasher performance.

In step 214, the controller 100 uses the recorded sensor data to identify the operating conditions that may have affected the user's satisfaction with the dishwashing cycle. For example, if the wares positioned in the upper dish rack 16 were not satisfactorily cleaned, the controller 100 accesses the sensor data stored in memory device 104 to determine the operating conditions present during the washing stages of the cycle. The controller 100 may identify the temperature of the fluid during the washing stages and/or identify the amount of soil present during the washing stages. The controller 100 may also determine the rate of change of the soil present over the course of the dishwashing cycle to identify the type of soil, such as, for example, baked-on soils that are removed more slowly. Additionally, the controller 100 may also determine the dish load present during the dishwashing cycle. When the controller 100 has identified at least one operation condition associated with user satisfaction, the routine 200 advances to step 216.

In step 216, the controller 100 selects one or more dishwasher operational parameters for adjustment based on user satisfaction. When the user has indicated she is dissatisfied with some characteristic of dishwasher performance, the controller 100 selects the operational parameter(s) associated with that characteristic. For example, if the dishwasher generated too much noise during the cycle, the controller 100 may select the operating pressure of the wash pump 60 as a parameter to adjust because the operating pressure affects the noise generated during the dishwashing cycle.

On the other hand, if the wares positioned in the upper dish rack 16 were not satisfactorily cleaned, the controller 100 may select the operating pressure of the wash pump 60 and/or the duration of the main washing stage for adjustment because each of those parameters affect cleaning performance. It will be appreciated that the controller 100 may select one or more operational parameters depending on the performance characteristic considered unsatisfactory.

The controller 100 may also select the operational parameters based on user satisfaction and the user preferences indicated in step 206. For example, as discussed above, if the wares positioned in the upper dish rack 16 were not satisfactorily cleaned, the operating pressure of the wash pump 60 and/or the duration of the main washing stage may be increased to improve cleaning performance. However, if the user indicated that shorter cycles were preferred, the controller 100 may select only the operating pressure for adjustment. In that way, the preferences are used to prioritize the operational parameters available for adjustment.

The controller 100 selects operational parameters for adjustment even when the user indicates that the dishwasher 10 performed satisfactorily. In that case, the controller 100 selects for adjustment the operational parameters that are associated with the user preferences indicated in step 206. For example, if the user indicated that the dishwasher 10 should be more ecologically-friendly, the controller 100 may select the duration of the main washing stage as a parameter to adjust because the duration of the main washing stage affects the overall efficiency of the dishwasher 10. Again, it should be appreciated that the controller 100 may select one or more operational parameters depending on the preferences indicated by the user. When the controller 100 has selected one or more operational parameters, the routine 200 advances to step 218.

In step 218, the controller 100 determines whether adjustments can be made to the selected operational parameter(s). The controller 100 first determines the current value of one of the selected operational parameters. Specifically, the controller 100 accesses the memory device 104 to identify the value of the selected operational parameter used during the dishwashing cycle. For example, if the controller 100 incorporated into the dishwashing cycle an adjusted operational parameter from the look-up table of historic operating conditions, the current value would be the value stored in the look-up table.

The controller 100 then compares the current value of the selected operational parameter to a predetermined threshold. The predetermined threshold may be, for example, a maximum duration for the drying stage or a maximum operating pressure for the wash pump 60. In other words, the predetermined threshold is a limit beyond which the controller 100 cannot modify the operational parameter. The predetermined threshold value of each of the operational parameters is stored in the memory device 104.

The controller 100 compares the current value to the predetermined threshold for the selected operational parameter to determine whether the current value equals the predetermined threshold. When the current value of the selected operational parameter is not equal to the predetermined threshold, further adjustments can be made to that operational parameter. Conversely, when the current value of a selected operational parameter is equal to its predetermined threshold, no further adjustments can be made to that operational parameter.

Before completing step 218, the controller 100 performs the comparison for each of the operational parameters selected in step 216. When the controller determines that further adjustments can be made to at least one of the selected operational parameters, the routine 200 proceeds to step 220. When no further adjustments can be made to any of the selected operational parameters, the routine 200 proceeds to step 222.

In step 220, the controller 100 adjusts the selected operational parameter(s) that can be adjusted. For example, the controller 100 may have selected in step 216 the operating pressure of the wash pump 60 and the duration of the main washing stage as parameters to adjust. If the controller 100 determined in step 218 that the current value of the operating pressure equaled its predetermined threshold while the current value of the duration of the main washing stage did not, the controller 100 would change the duration of the main washing stage and leave the operating pressure unchanged. In that way, the controller 100 would not increase the operating pressure beyond its predetermined threshold.

It will be appreciated that the controller 100 may access additional information while making each adjustment. The controller 100 may access the set-up information entered in step 206, such as the user's choice of detergent or rinse aid. The controller 100 may also access the data recorded by the sensors during the dishwashing cycle. Each of those details may change the adjustments made to the selected operational parameter. For example, if the user indicated a problem with spotting on glassware, the controller 100 may access the sensor data and the set-up information to determine whether rinse aid was used in the dishwashing cycle. If rinse aid was used, the controller 100 may change the number of times rinse aid is dispensed during the dishwashing cycle as well as decrease the temperature of the rinsing stage in order to address the spotting problem. If the controller 100 determines that rinse aid was likely not used or that the user prefers to not use rinse aid, the controller 100 may decrease the rinsing stage temperature by an even greater amount to address the spotting issue. In that way, the nature and/or amount of adjustment may change based on the user preferences and/or sensor data. When the controller 100 completes its adjustments, the routine 200 advances to step 224.

In step 224, the controller 100 stores the adjusted operational parameters in the memory device 104. As described above in connection with step 210, the memory device 104 has stored therein a look-up table containing a number of values of adjusted operational parameters stored as a function of historic operating conditions. The controller 100 adds the newly adjusted operational parameters to the table, storing the adjusted operational parameters as a function of the operating conditions determined in step 214. The newly adjusted parameters are therefore available for use in subsequent dishwashing cycles and may be incorporated into a subsequent cycle when the operating conditions present in the subsequent cycle are equal to the operating conditions stored in the look-up table. When the controller 100 has completed step 224, the routine 200 returns to step 202 and places the dishwasher 10 in the idle state until the user accesses the control panel 28.

Returning now to step 218, when the current values for each of the selected operational parameters are equal to their predetermined threshold, the routine 200 proceeds to step 222. In step 222, the controller 100 determines whether the dishwasher 10 has a performance problem that requires maintenance. To do this, the controller 100 first recalls the feedback received in step 212. If the user indicated satisfaction with the dishwashing cycle, the controller 100 concludes that the operational parameters associated with the user preferences have been adjusted to their limit and the dishwasher 10 is performing satisfactorily. That is, the controller 100 determines that the dishwashing cycle has been optimized in accordance with the user's preferences but no additional adjustments can be made to further optimize the performance of dishwasher 10. The routine 200 then returns to step 202 and places the dishwasher 10 in the idle state until the user accesses the control panel 28. If the user indicated dissatisfaction with dishwashing cycle, the controller 100 concludes that the dishwasher 10 likely has a fault that is causing poor performance, and the routine 200 proceeds to step 226.

In step 226, the controller 100 generates an error message indicating a fault in the dishwasher 10 and records the message in the memory device 104. In that way, the message is available for a service technician to access when making a service call message. The error message may include a record of the user's satisfaction with dishwasher performance over a number of dishwashing cycles. In addition, the error message may include the current values of each of the operational parameters of the dishwasher 10, the measurements recorded by the sensors during the concluded dishwasher cycle, and any other fault codes generated during the dishwashing cycle. In other embodiments, the error message may be displayed on the touchscreen 32, indicating to the user the need to call for service. Additionally, in other embodiments, rather than an error message, the touchscreen 32 may display a suggestion that the user select a different dishwashing cycle in order to improve performance. After the error message has been generated, the routine 200 returns to step 202 and places the dishwasher 10 in the idle state until the user accesses the control panel 28.

It will be appreciated that in some embodiments the dishwasher 10 may not include the touchscreen 32. In such embodiments, the user may indicate satisfaction or dissatisfaction by pressing only a single control or button 30 on the control panel 28. In such embodiments, the controller 100 may use the sensor data and other historical data to determine the operational parameters that should be adjusted.

Figure 4:
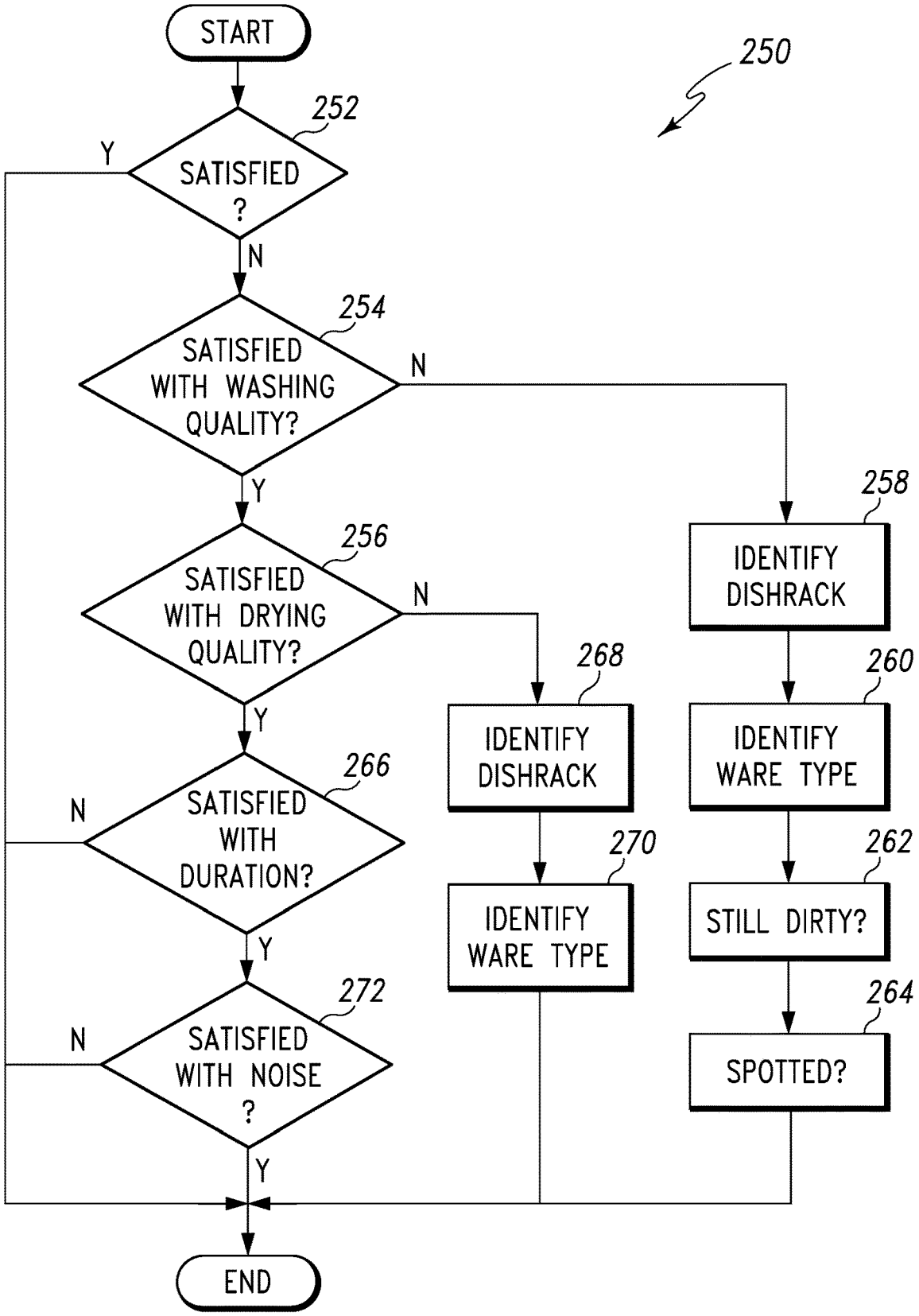
FIG. 4 is a simplified flow chart of a sub-routine for soliciting user feedback in the control routine of FIG. 3.

Referring now to FIG. 4, an illustrative embodiment of a sub-routine for determining user satisfaction and soliciting user feedback in the routine 200 is shown. The sub-routine (hereinafter sub-routine 250) begins with step 252 in which the touchscreen 32 displays instructions prompting the user to (1) touch a particular area of the touchscreen 32 or push a particular control 30 to indicate satisfaction with the performance of dishwasher 10 or (2) touch another area of the touchscreen 32 or push another control 30 to indicate dissatisfaction with the performance of dishwasher 10. If the user indicates she was satisfied, the controller 100 saves the user's response in the memory device 104. The sub-routine 250 ends, and the routine 200 then advances to step 214. If the user indicates she was dissatisfied, the sub-routine 250 proceeds to step 254.

In step 254, the touchscreen 32 displays instructions prompting the user to indicate whether she was satisfied with the washing quality. If the user indicates she was satisfied, the sub-routine 250 advances to step 256. If the user indicates she was dissatisfied with washing quality, the sub-routine 250 proceeds to step 258.

In step 258, the touchscreen 32 displays instructions prompting the user to identify where the wares exhibiting poor washing quality were located in the washing chamber 14. In the illustrative embodiment, the touchscreen 32 prompts the user to identify the dish rack 16. It will be appreciated that in other embodiments, the touchscreen 32 may prompt the user to identify the wash zone in which the ware was located or any other aspect of the position of the ware within the washing chamber 14. When the user identifies the dish rack 16, the sub-routine 250 proceeds to step 260.

In step 260, the touchscreen 32 displays instructions prompting the user to identify the ware type. For example, if the user identified the upper dish rack 16 as a location exhibiting poor washing performance, the touchscreen 32 may display glassware, plastics, or mugs as ware types for the user to select from. When the user identifies the ware type, the sub-routine 250 proceeds to step 262.

In step 262, the touchscreen 32 displays instructions that prompt the user to indicate whether the identified ware was still dirty at the end of the dishwashing cycle. When the user touches the appropriate area of the touchscreen 32 or pushes the appropriate control 30 in response to this prompt, the sub-routine 250 advances to step 264. In step 264, the touchscreen 32 displays instructions prompting the user to indicate whether the identified ware exhibited unsatisfactory spotting. When the user touches the appropriate area of the touchscreen 32 or pushes the appropriate control 30 to respond to this prompt, the controller 100 saves the user's responses in the memory device 104. The sub-routine 250 ends, and the routine 200 then advances to step 214.

Returning to step 254, if the user indicates she was satisfied with washing quality, the sub-routine proceeds to step 256. In step 256, the touchscreen 32 displays instructions prompting the user to indicate whether she was satisfied with the drying quality. If the user indicates she was satisfied, the sub-routine 250 advances to step 266. If the user indicates she was dissatisfied, the sub-routine 250 proceeds to step 268.

In step 268, like step 258, discussed above, the touchscreen 32 displays instructions prompting the user to identify where the wares exhibiting poor drying quality were located in the washing chamber 14. When the user touches the area of the touchscreen 32 or pushes the control 30 associated with location exhibiting poor drying quality, the sub-routine 250 proceeds to step 270. In step 270, like step 260 discussed above, the touchscreen 32 displays instructions prompting the user to identify the ware type. When the user touches the appropriate area of the touchscreen 32 or pushes the appropriate control 30, the controller 100 saves the user's responses in the memory device 104. The sub-routine 250 then ends, and the routine 200 advances to step 214.

Returning to step 256, if the user indicates she was satisfied with drying quality, the sub-routine 250 proceeds to step 266. In step 266, the touchscreen 32 displays instructions prompting the user to indicate whether she was satisfied with the speed or duration of the dishwashing cycle. If the user indicates she was dissatisfied with the duration of the cycle, the controller 100 saves the user's responses in the memory device 104, and the sub-routine 250 ends. If the user indicates she was satisfied, the sub-routine 250 advances to step 272.

In step 272, the touchscreen 32 displays instructions prompting the user to indicate whether she was satisfied with the amount of noise generated during the dishwashing cycle. When the user touches the appropriate area of the touchscreen 32 or pushes the appropriate control 30 to respond to this prompt, the controller 100 saves the user's responses in the memory device 104. The sub-routine 250 then ends, and the routine 200 advances to step 214.

As will be appreciated by those of the skill in the art, the control routine may include elements other than those shown and described above. For example, the user may be prompted to indicate satisfaction with other characteristics of dishwasher performance. The user might be prompted to indicate whether the dishes were damaged; additionally or alternatively, the user might be prompted to identify a spray zone exhibiting unsatisfactory washing quality.

While the above disclosure relates specifically to a dishwasher, it will be appreciated that the general concept of adjusting the operation of an appliance based on user satisfaction may be applied to other appliances. For example, the operation of a clothes' washer could be adjusted based on user satisfaction with the cleaning quality, noise level, cycle time, or the like. In a similar way, the general concept could be applied to dryers, cooking ovens, ranges, microwaves, and other like devices.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A method of operating an appliance with an electronic controller configured to perform the method steps listed below, the method comprising:

operating the appliance in accordance with a selected appliance operation;

determining user satisfaction with an appliance operation by:

soliciting user input regarding each of a plurality of different characteristics of appliance performance;

receiving individual user-input signals indicative of the user satisfaction for the plurality of different characteristics for the appliance operation; and identifying at least one unsatisfactory characteristic of appliance performance based on the user-input signals;

adjusting at least one operational parameter of the appliance operation based on the user satisfaction; and incorporating the at least one adjusted operational parameter into a subsequent appliance operation.

2. The method of claim 1, wherein the appliance is a washing machine.

3. The method of claim 2, wherein the washing machine is a clothes washer, and determining the user satisfaction includes determining the user satisfaction with a wash cycle.

4. The method of claim 2, wherein the plurality of different characteristics of appliance performance includes washing quality.

5. The method of claim 1, wherein the appliance is a dryer, range, oven or microwave.

6. The method of claim 1, wherein the plurality of different characteristics of appliance performance includes drying quality.

7. The method of claim 1, wherein the plurality of different characteristics of appliance performance includes noise generated during the appliance operation.

8. The method of claim 1, wherein the plurality of different characteristics of appliance performance includes appliance operation duration.

9. The method of claim 1, wherein adjusting the at least one operational parameter of the appliance operation includes:

selecting an operational parameter associated with the at least one unsatisfactory characteristic of appliance performance; and adjusting the selected operational parameter, wherein adjusting the selected operational parameter includes determining whether additional adjustments are available for the selected operational parameter.

10. The method of claim 1, further comprising:

identifying at least one operating condition of the appliance operation associated with the user satisfaction, wherein the at least one adjusted operational parameter is incorporated into the subsequent appliance operation when the identified operating condition is present in the subsequent appliance operation.

11. An appliance comprising:

an electronic controller configured to:

operate the appliance in accordance with a selected appliance operation;

determine user satisfaction with the selected appliance operation by:

soliciting user input regarding each of a plurality of different characteristics of appliance performance;

receiving individual user-input signals indicative of the user satisfaction for each of the plurality of different characteristics for the selected appliance operation; and identifying at least one unsatisfactory characteristic of appliance performance based on the user-input signals;

adjust at least one operational parameter of the selected appliance operation based on the user satisfaction; and incorporate the at least one adjusted operational parameter into a subsequent appliance operation.

12. The appliance of claim 11, wherein the appliance is a washing machine.

13. The appliance of claim 12, wherein the washing machine is a clothes washer, and the electronic controller is configured to determine the user satisfaction with a wash cycle.

14. The appliance of claim 12, wherein the plurality of different characteristics of appliance performance includes washing quality.

15. The appliance of claim 11, wherein the appliance is a dryer, range, oven or microwave.

16. The appliance of claim 11, wherein the plurality of different characteristics of appliance performance includes drying quality.

17. The appliance of claim 11, wherein the plurality of different characteristics of appliance performance includes noise generated during the appliance operation.

18. The appliance of claim 11, wherein the plurality of different characteristics of appliance performance includes appliance operation duration.

19. The appliance of claim 11, wherein adjusting the at least one operational parameter of the appliance operation includes:

selecting an operational parameter associated with the at least one unsatisfactory characteristic of appliance performance; and adjusting the selected operational parameter, wherein the adjusting the selected operational parameter includes determining whether additional adjustments are available for the selected operational parameter.

20. The appliance of claim 11, wherein:

the controller is further configured to identify at least one operating condition of the appliance operation associated with the user satisfaction; and the at least one adjusted operational parameter is incorporated into the subsequent appliance operation when the identified operating condition is present in the subsequent appliance operation.

* * * * *